US008129323B2

(12) United States Patent
Appleby et al.

(10) Patent No.: US 8,129,323 B2
(45) Date of Patent: Mar. 6, 2012

(54) SOLID LAUNDRY DETERGENT COMPOSITION COMPRISING ALKYL BENZENE SULPHONATE, CARBONATE SALT AND CARBOXYLATE POLYMER

(75) Inventors: Doris Appleby, Newcastle-upon-Tyne (GB); Alan Thomas Brooker, Newcastle-upon-Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 426 days.

(21) Appl. No.: 11/505,002

(22) Filed: Aug. 16, 2006

(65) Prior Publication Data

US 2007/0042932 A1 Feb. 22, 2007

(30) Foreign Application Priority Data

Aug. 19, 2005 (EP) ..... 05018028

(51) Int. Cl.

| | |
|---|---|
| ***C11D 17/06*** | (2006.01) |
| ***C11D 1/22*** | (2006.01) |
| ***C11D 3/10*** | (2006.01) |
| ***C11D 3/37*** | (2006.01) |

(52) U.S. Cl. ..... 510/276; 510/351; 510/352; 510/357; 510/361; 510/445; 510/477; 510/509

(58) Field of Classification Search ..... 510/276, 510/351, 352, 357, 361, 445, 477, 509
See application file for complete search history.

(56) References Cited

U.S. PATENT DOCUMENTS

| | | | | |
|---|---|---|---|---|
| 3,629,951 | A | 12/1971 | Davis et al. | |
| 3,629,955 | A | 12/1971 | Davis et al. | |
| 3,703,772 | A | 11/1972 | McHugh et al. | |
| 4,687,592 | A | 8/1987 | Collins et al. | |
| 5,496,487 | A | 3/1996 | Capeci et al. | |
| 5,496,495 | A * | 3/1996 | Beck et al. | 510/361 |
| 5,552,078 | A | 9/1996 | Carr et al. | |
| 5,712,242 | A | 1/1998 | Aouad et al. | |
| 5,756,444 | A | 5/1998 | Walters et al. | |
| 5,962,389 | A | 10/1999 | Partee et al. | |
| 5,977,053 | A * | 11/1999 | Groth et al. | 510/480 |
| 6,274,545 | B1 | 8/2001 | Mazzola et al. | |
| 6,288,016 | B1 | 9/2001 | Ramanan et al. | |
| 6,509,310 | B1 | 1/2003 | Huish et al. | |
| 6,528,474 | B1 | 3/2003 | Gonzalez et al. | |
| 7,078,373 | B2 * | 7/2006 | Burrows et al. | 510/351 |
| 2002/0028755 | A1 | 3/2002 | VanDijk et al. | |
| 2003/0158069 | A1 | 8/2003 | Horne et al. | |
| 2003/0211963 | A1 * | 11/2003 | Bettiol et al. | 510/499 |
| 2003/0228992 | A1 * | 12/2003 | Smets et al. | 510/267 |
| 2004/0097394 | A1 | 5/2004 | Burrows et al. | |
| 2004/0116320 | A1 * | 6/2004 | Bettiol et al. | 510/499 |
| 2004/0147426 | A1 * | 7/2004 | Bettiol et al. | 510/475 |
| 2005/0009727 | A1 * | 1/2005 | Bettiol et al. | 510/499 |
| 2005/0187130 | A1 * | 8/2005 | Brooker et al. | 510/445 |
| 2005/0187131 | A1 * | 8/2005 | Brooker et al. | 510/446 |
| 2006/0014655 | A1 * | 1/2006 | Smets et al. | 510/101 |
| 2006/0035802 | A1 * | 2/2006 | Brooker et al. | 510/445 |
| 2006/0035803 | A1 * | 2/2006 | Mort et al. | 510/445 |
| 2007/0037726 | A1 * | 2/2007 | Brooker et al. | 510/476 |
| 2007/0042926 | A1 | 2/2007 | Roberts | |
| 2007/0042927 | A1 | 2/2007 | Muller et al. | |
| 2007/0042928 | A1 | 2/2007 | Appleby et al. | |
| 2007/0042931 | A1 | 2/2007 | Roberts et al. | |

FOREIGN PATENT DOCUMENTS

| | | | |
|---|---|---|---|
| EP | 0349199 | | 1/1990 |
| EP | 1111034 | A1 * | 6/2001 |
| EP | 1693441 | B1 | 1/2009 |
| WO | WO 97/43366 | | 11/1997 |
| WO | WO98/20105 | | 5/1998 |
| WO | WO 00/18859 | | 4/2000 |
| WO | WO 00/18873 | | 4/2000 |
| WO | WO 02/053691 | | 7/2002 |
| WO | WO 2005/052105 | A | 6/2005 |
| WO | WO 2005/083046 | A | 9/2005 |
| WO | WO 2005/083049 | A | 9/2005 |
| WO | WO2006/020789 | A1 | 2/2006 |

OTHER PUBLICATIONS

U.S. Appl. No. 11/504,918, filed Aug. 15, 2006, Roberts et al.
Search Report and Written Opinion from the International Searching Authority, mailed on Dec. 22, 2006, International Application No. PCT/IB2006/052851, 10 pages.

* cited by examiner

*Primary Examiner* — Lorna M Douyon
(74) *Attorney, Agent, or Firm* — Gary J. Foose; Ronald Terk Sia; Mark A. Charles

(57) ABSTRACT

A solid laundry detergent composition in particulate form comprising a plurality of particulate components, the composition comprises: alkyl benzene sulphonate anionic detersive surfactant; carboxylate polymer; carbonate salt; from 0% to less than 5%, by weight of the composition, of zeolite builder; from 0% to less than 5%, by weight of the composition, of phosphate builder; and essentially free silicate salt; wherein any particulate component that comprises at least 5%, by weight of the particulate component, of alkyl benzene sulphonate anionic detersive surfactant comprises a specific amount of carbonate salt to carboxylate polymer; and wherein the composition has a specific weight ratio of carbonate salt to carboxylate polymer.

6 Claims, No Drawings

SOLID LAUNDRY DETERGENT COMPOSITION COMPRISING ALKYL BENZENE SULPHONATE, CARBONATE SALT AND CARBOXYLATE POLYMER

FIELD OF THE INVENTION

The present invention relates to under-built highly soluble solid laundry detergent compositions comprising alkyl benzene sulphonate, carbonate salt and carboxylate polymer. The compositions of the present invention have a good cleaning performance and good dispensing and dissolution profiles.

BACKGROUND OF THE INVENTION

There have been relatively recent attempts by many detergent manufacturers to significantly improve the dissolution and dispensing performance of their granular laundry detergents. The approach many detergent manufacturers have focused on is the significant reduction in the level of, or even the complete removal of, water-insoluble builder, such as zeolite builder, in/from their granular laundry detergent formulations. However, due to the phosphate-usage avoidance legislation in many countries which prevents the detergent manufacturers from incorporating a sufficient amount of phosphate-based water-soluble builders, such as sodium tripolyphosphate, in their granular laundry detergents, and due to the lack of feasible alternative non-phosphate based water-soluble builders available to the detergent manufacturers, the approach many detergent manufacturers have focused on is to not completely replace the zeolite-based builder system with a water-soluble builder system having an equivalent degree of builder capability, but instead to formulate an under-built granular laundry detergent composition.

Whilst this under-built approach does significantly improve the dissolution and dispensing performance of the granular laundry detergent, problems do exist due to the significant amount of cations, such as calcium, that are not removed from the wash liquor by the builder-system of the granular laundry detergent composition during the laundering process. These cations interfere with the anionic detersive surfactant system of the granular laundry detergent composition in such a manner as to cause the anionic detersive surfactant to precipitate out of solution, which leads to a reduction in the anionic detersive surfactant activity and cleaning performance. In extreme cases, these water-insoluble complexes may deposit onto the fabric resulting in poor whiteness maintenance and poor fabric integrity benefits. This is especially problematic when the laundry detergent is used in hard-water washing conditions when there is a high concentration of calcium cations.

Another problem that needs to be overcome when the level of water-insoluble builders such as zeolite are significantly reduced in the composition, or when the zeolite is completely removed from the formulation, is the poor physical characteristics of the composition, especially after storage, which result in a poor cake strength.

The Inventors have found that the cleaning performance and physical characteristics of under-built detergent compositions is improved by carefully controlling where and how much carbonate salt and carboxylate polymer are incorporated into the composition relative to the alkyl benzene sulphonate.

U.S. Pat. No. 5,552,078 by Carr et al, Church & Dwight Co. Inc., relates to a powdered laundry detergent composition comprising an active surfactant, at least 70 wt % of a water-soluble alkaline carbonate salt, e.g. sodium carbonate, from 0.1 wt % to 2 wt % of a phosphate-builder, e.g. sodium tripolyphosphate, from 0.1 wt % to 2 wt % of a carboxylate polymer, and from 1 wt % to 12 w of water. It is alleged that compositions of U.S. Pat. No. 5,552,078 exhibit excellent cleaning and whitening of fabrics whilst avoiding the problem of eutrophication which occurs when a substantial amount of phosphate-builder is present in the composition, and while minimizing the problem of fabric-encrustation often present when the composition contains a large amount of carbonate builder. However, U.S. Pat. No. 5,552,078 does not give any details about how ingredients such as surfactant, carboxylate polymer and carbonate salt are incorporated into the composition, and U.S. Pat. No. 5,552,078 gives no details about the make-up of individual particles within the composition.

U.S. Pat. No. 6,274,545 B1 by Mazzola, Church & Dwight Co. Inc., relates to a high-carbonate low-phosphate powder laundry detergent formulation which can allegedly be utilized in cold water fabric laundering with a minimized remainder of undissolved detergent residue in the wash liquor. The detergent composition of U.S. Pat. No. 6,274,545 B1 comprises an anionic/nonionic surfactant blend that is a partially sulphated and neutralized ethoxylated alcohol surfactant, and a polyethylene glycol ingredient, which allegedly increases the solubility of the laundry detergent solids in the wash liquor. However, the compositions of U.S. Pat. No. 6,274,545 B1 do not comprise any alkyl benzene sulphonate. In addition, U.S. Pat. No. 6,274,545 B1 does not give any details about how ingredients such as surfactant, carboxylate polymer and carbonate salt are incorporated into the composition, and U.S. Pat. No. 6,274,545 B1 gives no details about the make-up of individual particles within the composition.

WO97/43366 by Askew et al, The Procter & Gamble Company, relates to a detergent composition that comprises an effervescence system. WO97/43366 exemplifies a carbonate built bleach-free detergent composition. However, WO97/43366 does not give any details about how ingredients such as surfactant, carboxylate polymer and carbonate salt are incorporated into the composition.

WO00/18873 by Hartshorn et al, The Procter & Gamble Company, relates to detergent compositions having allegedly good dispensing performance and allegedly do not leave residues on the fabric after the laundering process. However, the example compositions of WO00/18873 all comprise an agglomerate of alkylbenzene sulphonate that does not comprise any carbonate salt or any carboxylate polymer.

WO00/18859 by Hartshorn et al, The Procter & Gamble Company, relates to detergent compositions allegedly having an improved delivery of ingredients into the wash liquor during the laundering process. The compositions of WO00/18859 allegedly do not as readily gel upon contact with water and allegedly do not leave water-insoluble residues on clothes after the laundering process. The compositions of WO0/18859 comprise a predominantly water-soluble builder system that is intimately mixed with a surfactant system. However, the example compositions of WO00/18859 are either zeolite built and/or comprise a particle of alkylbenzene sulphonate that does not comprise any carbonate salt and/or a carboxylate polymer.

WO02/053691 by Van der Hoeven et al, Hindustain Lever Limited, relates to a laundry detergent composition comprising greater than 10 wt % of a calcium tolerant surfactant, from 0.1 wt % to 10 wt % of a strong builder system selected from phosphate builders and/or zeolite builders, and less than 35 wt % of non-functional non-alkaline water-soluble inorganic salts. However, WO02/053691 does not give any details about how ingredients such as surfactant, carboxylate polymer and carbonate salt are incorporated into the composition.

SUMMARY OF THE INVENTION

The present invention provides a solid laundry detergent composition in particulate form comprising a plurality of particulate components, the composition comprises: (i) alkyl benzene sulphonate anionic detersive surfactant; (ii) carboxylate polymer; (iii) carbonate salt; (iv) from 0% to less than 5%, by weight of the composition, of zeolite builder; (v) from 0% to less than 5%, by weight of the composition, of phosphate builder; and (vi) optionally from 0% to less than 5%, by weight of the composition, of silicate salt; wherein: (a) any particulate component that comprises at least 5%, by weight of the particulate component, of alkyl benzene sulphonate anionic detersive surfactant also comprises carbonate salt, wherein weight ratio of the carbonate salt to the alkyl benzene sulphonate anionic detersive surfactant in the particulate component is greater than 1:1; (b) any particulate component that comprises at least 5%, by weight of the particulate component, of alkyl benzene sulphonate anionic detersive surfactant also comprises carboxylate polymer, wherein the weight ratio of the alkyl benzene sulphonate anionic detersive surfactant to the carboxylate polymer in the particulate component is in the range of from 0.2:1 to 5:1; and (c) any particulate component that comprises at least 5%, by weight of the particulate component, of alkyl benzene sulphonate anionic detersive surfactant also comprises from 0% to 10%, by weight of the particulate component, of silicate salt; and (d) the weight ratio of carbonate salt to carboxylate polymer present in the composition is in the range of from 1:1 to 30:1.

DETAILED DESCRIPTION OF THE INVENTION

Solid Laundry Detergent Composition

The composition comprises alkyl benzene sulphonate anionic detersive surfactant, carboxylate polymer, carbonate salt, from 0 to 5%, by weight of the composition, of zeolite builder, from 0% to less than 5%, by weight of the composition of phosphate builder, and optionally from 0% to less than 5%, by weight of the composition, of silicate salt. The composition may comprise other adjunct components.

The composition is in particulate form, such as an agglomerate, a spray-dried powder, an extrudate, a flake, a needle, a noodle, a bead, or any combination thereof. The composition may be in compacted-particulate form, such as in the form of a tablet. Then composition may be some other unit dose form, such as a pouch; typically being at least partically, preferably essentially completely, enclosed by a water-soluble film, such as polyvinyl alcohol. Preferably, the composition is in free-flowing particulate form; by free-flowing particulate form, it is typically meant that the composition is in the form of separate discrete particles. The composition may be made by any suitable method including agglomeration, spray-drying, extrusion, mixing, dry-mixing, liquid spray-on, roller compaction, spheronisation, tabletting or any combination thereof.

The composition typically has a bulk density of from 450 g/l to 1,000 g/l, preferred low bulk density detergent compositions have a bulk density of from 550 g/l to 650 g/l and preferred high bulk density detergent compositions have a bulk density of from 750 g/l to 900 g/l. During the laundering process, the composition is typically contacted with water to give a wash liquor having a pH of from above 7 to less than 13, preferably from above 7 to less than 10.5. This is the optimal pH to provide good cleaning whilst also ensuring a good fabric care profile.

The composition comprises a plurality of particulate components. Any particulate component that comprises at least 5%, or preferably at least 10%, or at least 15%, by weight of the particulate component, of alkyl benzene sulphonate anionic detersive surfactant also comprises carbonate salt, wherein the weight ratio of the carbonate salt to the alkyl benzene sulphonate anionic detersive surfactant present in the particulate component is greater than 1:1, preferably greater than 1.2:1, or greater than 1.3:1, or greater than 1.4:1, or greater than 1.5:1, or greater than 1.6:1, or greater than 1.7:1, or greater than 1.8:1, and preferably to 30:1, or to 25:1, or to 20:1, or to 15:1, or to 10:1. These ratios ensure that the composition has a good cleaning performance and good physical characteristics such as good cake strength, especially after storage.

Furthermore, any particulate component that comprises at least 5%, or preferably at least 10%, or even at least 15%, by weight of the particulate component, of alkyl benzene sulphonate anionic detersive surfactant also comprises carboxylate polymer, wherein the weight ratio of the alkyl benzene sulphonate anionic detersive surfactant to the carboxylate polymer present in the particulate component is in the range of from 0.2:1 to 5:1, preferably from 0.5, or from 1:1, or from 1.5:1, or from 2:1, and preferably to 4:1, or to 3:1. These ratios ensure that the composition has a good cleaning performance and good physical characteristics such as good cake strength, especially after storage.

In addition, any particulate component that comprises at least 5%, by weight of the particulate component, of alkyl benzene sulphonate anionic detersive surfactant also comprises from 0% to 10%, preferably to 8%, or to 6%, or to 4%, or to 2%, by weight of the particulate component, of silicate salt, preferably the particulate component is essentially free of silicate salt. By essentially free of silicate salt is typically meant that the particulate component comprises no deliberately added silicate salt.

The weight ratio of carbonate salt to carboxylate polymer in the composition is in the range of from 1:1 to 30:1, preferably from 2:1, or from 4:1, or from 5:1, or from 6:1, or from 8:1, and preferably to 25:1, or to 20:1, or to 15:1, or to 10:1. These ratios ensure that the composition has a good cleaning performance and good physical characteristics such as good cake strength, especially after storage.

The composition typically has an equilibrium relative humidity of from 0% to less than 30%, preferably from 0% to 20%, when measured at a temperature of 35° C. Typically, the equilibrium relative humidity is determined as follows: 300 g of composition is placed in a 1 liter container made of a water-impermeable material and fitted with a lid capable of sealing the container. The lid is provided with a sealable hole adapted to allow insertion of a probe into the interior of the container. The container and its contents are maintained at a temperature of 35° C. for 24 hours to allow temperature equilibration. A solid state hygrometer (Hygrotest 6100 sold by Testoterm Ltd, Hapshire, UK) is used to measure the water vapour pressure. This is done by inserting the probe into the interior of the container via the sealable hole in the container's lid and measuring the water vapour pressure of the head space. These measurements are made at 10 minute intervals until the water vapour pressure has equilibrated. The probe then automatically converts the water vapour pressure reading into an equilibrium relative humidity value.

Preferably, the composition upon contact with water at a concentration of 9.2 g/l and at a temperature of 20° C. forms a transparent wash liquor having (i) a turbidity of less than 500 nephelometric turbidity units; and (ii) a pH in the range of from 8 to 12. Preferably, the resultant wash liquor has a turbidity of less than 400, or less than 300, or from 10 to 300 nephelometric turbidity units. The turbidity of the wash liquor is typically measured using a H1 93703 microprocessor turbidity meter. A typical method for measuring the turbidity of the wash liquor is as follows: 9.2 g of composition is added to 1 liter of water in a beaker to form a solution. The solution is stirred for 5 minutes at 600 rpm at 20° C. The turbidity of the solution is then measured using a H1 93703 microprocessor turbidity meter following the manufacturer's instructions.

Alkyl Benzene Sulphonate

The composition comprises alkyl benzene sulphonate, preferably a linear or branched, substituted or unsubstituted, $C_{8-24}$ alkyl benzene sulphonate. Preferably the composition comprises from 0.1%, or from 1%, or from 2.5%, or from 5%, or from 7.5%, or from 10%, and to 50%, or to 40%, or to 30%, or to 20%, by weight of the composition, of a linear or branched, substituted or unsubstituted, $C_{8-24}$ alkyl benzene sulphonate. This is the optimal level of the alkyl benzene sulphonate to provide a good cleaning performance. The $C_{8-24}$ alkyl benzene sulphonate can be a modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548. Highly preferred $C_{8-24}$ alkyl benzene sulphonates are linear $C_{10-13}$ alkylbenzene sulphonates. Especially preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

The $C_{8-24}$ alkyl benzene sulphonate is typically in particulate form, such as an agglomerate, a spray-dried powder, an extrudate, a bead, a noodle, a needle or a flake. It may be preferred for part of the $C_{8-24}$ alkyl benzene sulphonate to be in the form of a spray-dried powder (e.g. a blown powder), and for part of the $C_{8-24}$ alkyl benzene sulphonate to be in the form of a non-spray-dried powder (e.g. an agglomerate, or an extrudate, or a flake such as a linear alkyl benzene sulphonate flake; suitable linear alkyl benzene sulphonate flakes are supplied by Pilot Chemical under the tradename F90®, or by Stepan under the tradename Nacconol 90G®). This is especially preferred when it is desirable to incorporate high levels of the $C_{8-18}$ alkyl benzene sulphonate in the composition.

Carboxylate Polymer

The composition comprises carboxylate polymer. It may be preferred for the composition to comprise at least 1%, or at least 2%, or at least 3%, or at least 4%, or even at least 5%, by weight of the composition, of carboxylate polymer. The carboxylate polymer can sequester free calcium ions in the wash liquor. The carboxylate polymers can also act as soil dispersants and can provide an improved particulate stain removal cleaning benefit. Preferred polymeric polycarboxylates include: polyacrylates, preferably having a weight average molecular weight of from 1,000 Da to 20,000 Da; co-polymers of maleic acid and acrylic acid, preferably having a molar ratio of maleic acid monomers to acrylic acid monomers of from 1:1 to 1:10 and a weight average molecular weight of from 10,000 Da to 200,000 Da, or preferably having a molar ratio of maleic acid monomers to acrylic acid monomers of from 0.3:1 to 3:1 and a weight average molecular weight of from 1,000 Da to 50,000 Da.

Carbonate Salt

The composition comprises carbonate salt, typically from 1% to 50%, or from 5% to 25% or from 10% to 20%, by weight of the composition, of carbonate salt. A preferred carbonate salt is sodium carbonate and/or sodium bicarbonate. A highly preferred carbonate salt is sodium carbonate. Preferably, the composition may comprise from 10% to 40%, by weight of the composition, of sodium carbonate. However, it may also be preferred for the composition to comprise from 2% to 8%, by weight of the composition, of sodium bicarbonate. Sodium bicarbonate at these levels provides good alkalinity whilst minimizing the risk of surfactant gelling which may occur in surfactant-carbonate systems. If the composition comprises sodium carbonate and zeolite, then preferably the weight ratio of sodium carbonate to zeolite is at least 15:1.

The carbonate salt, or at least part thereof, is typically in particulate form, typically having a weight average particle size in the range of from 200 to 500 micrometers. However, it may be preferred for the carbonate salt, or at least part thereof, to be in micronised particulate form, typically having a weight average particle size in the range of from 4 to 40 micrometers; this is especially preferred when the carbonate salt, or at least part thereof, is in the form of a co-particulate admixture with a detersive surfactant, such as the alkyl benzene sulphonate, or alternatively with an alkoxylated anionic detersive surfactant.

High levels of carbonate improve the cleaning performance of the composition by increasing the pH of the wash liquor. This increased alkalinity: improves the performance of the bleach, if present; increases the tendency of soils to hydrolyse, which facilitates their removal from the fabric; and also increases the rate, and degree, of ionization of the soils to be cleaned (n.b. ionized soils are more soluble and easier to remove from the fabrics during the washing stage of the laundering process). In addition, high carbonate levels improve the flowability of the composition when the detergent composition, especially when the composition is in free-flowing particulate form.

Zeolite Builder

The composition comprises from 0% to less than 5%, or to 4%, or to 3%, or to 2%, or to 1%, by weight of the composition, of zeolite builder. It may even be preferred for the composition to be essentially free from zeolite builder. By essentially free from zeolite builder it is typically meant that the composition comprises no deliberately added zeolite builder. This is especially preferred if it is desirable for the composition to be very highly soluble, to minimise the amount of water-insoluble residues (for example, which may deposit on fabric surfaces), and also when it is highly desirable to have transparent wash liquor. Zeolite builders include zeolite A, zeolite X, zeolite P and zeolite MAP.

Phosphate Builder

The composition comprises from 0% to less than 5%, or to 4%, or to 3%, or to 2%, or to 1%, by weight of the composition, of phosphate builder. It may even be preferred for the composition to be essentially free from phosphate builder. By essentially free from phosphate builder it is typically meant that the composition comprises no deliberately added phosphate builder. This is especially preferred if it is desirable for the composition to have a very good environmental profile. Phosphate builders include sodium tripolyphosphate.

Silicate Salt

The composition optionally comprises from 0% to less than 5%, or to 4%,or to 3%, or to 2%, or to 1%, by weight of the composition, of a silicate salt. Whilst the composition may comprise silicate salt at a level of 5 wt % or greater, preferably the composition comprises less than 5 wt % silicate salt. It may even be preferred for the composition to be essentially free from silicate salt. By essentially free from silicate salt it is typically meant that the composition comprises no deliberately added silicate. This is especially preferred in order to ensure that the composition has a very good dispensing and dissolution profiles and to ensure that the composition provides a clear wash liquor upon dissolution in water. Silicate salts include water-insoluble silicates. Silicate salts include amorphous silicates and crystalline layered silicates (e.g. SKS-6). A preferred silicate salt is sodium silicate.

Adjunct Ingredients

The composition typically comprises adjunct ingredients. These adjunct ingredients include: detersive surfactants such as anionic detersive surfactants, nonionic detersive surfactants, cationic detersive surfactants, zwitterionic detersive surfactants, amphoteric detersive surfactants; preferred anionic detersive surfactants are alkoxylated anionic detersive surfactants such as linear or branched, substituted or unsubstituted $C_{12-18}$ alkyl alkoxylated sulphate having an average degree of alkoxylation of from 1 to 30, preferably from 1 to 10, more preferably a linear or branched, substituted or unsubstituted $C_{12-18}$ alkyl ethoxylated sulphate having an average degree of ethoxylation of from 1 to 10, most preferably a linear unsubstituted $C_{12-18}$ alkyl ethoxylated sulphate having an average degree of ethoxylation of from 3 to 7, other preferred anionic detersive surfactants are alkyl sulphates, an alkyl sulphonates, an alkyl phosphates, an alkyl phosphonates, an alkyl carboxylates or any mixture thereof; preferred nonionic detersive surfactants are $C_{8-18}$ alkyl alkoxylated alcohols having an average degree of alkoxylation of from 1 to 20, preferably from 3 to 10, most preferred are $C_{12-18}$ alkyl ethoxylated alcohols having an average degree of alkoxylation of from 3 to 10; preferred cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; enzymes such as amylases, carbohydrases, cellulases, laccases, lipases, oxidases, peroxidases, proteases, pectate lyases and mannanases; suds suppressing systems such as silicone based suds suppressors; fluorescent whitening agents; photobleach; filler salts such as sulphate salts, preferably sodium sulphate; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as alkoxylated polyamines and ethoxylated ethyleneimine polymers; anti-redeposition components such as carboxymethyl cellulose and polyesters; perfumes; sulphamic acid or salts thereof; citric acid or salts thereof; and dyes such as orange dye, blue dye, green dye, purple dye, pink dye, or any mixture thereof.

Preferably, the composition comprises less than 1 wt % chlorine bleach and less than 1 wt % bromine bleach. Preferably, the composition is essentially free from bromine bleach and chlorine bleach. By "essentially free from" it is typically meant "comprises no deliberately added".

EXAMPLES

The following solid laundry detergent compositions are in accordance with the present invention:

| | A | B | C | D | E | F |
|---|---|---|---|---|---|---|
| Spray-dried particles | | | | | | |
| $C_{10-13}$ linear alkyl benzene sulfonate | 7.50 | 7.50 | 7.50 | 7.50 | 7.50 | 7.50 |
| $C_{12-16}$ alkyl ethoxylated sulphate having an average ethoxylation degree of 3 | | 1.00 | 1.00 | | | |
| Hydroxyethane di(methylene phosphonic acid) | 0.20 | 0.20 | 0.20 | 0.20 | 0.20 | 0.20 |
| Ethylenediamine disuccinic acid | 0.25 | 0.25 | 0.25 | 0.25 | 0.25 | 0.25 |
| Acrylate/maleate copolymer | 2.50 | 2.50 | 2.50 | 2.50 | 2.50 | 2.50 |
| Sodium carbonate | 22.50 | 22.50 | 22.50 | 22.50 | 22.50 | 22.50 |
| Fluorescent-whitening agent | 0.15 | 0.15 | 0.15 | 0.15 | 0.15 | 0.15 |
| Magnesium sulphate | 0.45 | 0.45 | 0.45 | 0.45 | 0.45 | 0.45 |
| Sodium sulphate | 16.15 | 17.65 | 17.65 | 16.15 | 16.15 | 16.15 |
| Miscellaneous and water | 4.00 | 4.00 | 4.00 | 4.00 | 4.00 | 4.00 |
| Total spray-dried particles | 53.70 | 56.20 | 56.20 | 53.70 | 53.70 | 53.70 |
| Surfactant agglomerate | | | | | | |
| $C_{12-16}$ alkyl ethoxylated sulphate having an average ethoxylation degree of 3 | 6.00 | 6.00 | | 6.00 | 6.00 | 5.00 |

-continued

| | A | B | C | D | E | F |
|---|---|---|---|---|---|---|
| $C_{10-13}$ linear alkyl benzene sulfonate | | | 5.00 | | | 1.00 |
| Sodium carbonate | 17.00 | 17.00 | 15.00 | 17.00 | 17.00 | 15.00 |
| Acrylate/maleate copolymer | | | 1.50 | | | 1.50 |
| Miscellaneous and water | 1.00 | 1.00 | 1.00 | 1.00 | 1.00 | 1.50 |
| Total surfactant agglomerate | 24.00 | 24.00 | 22.50 | 24.00 | 24.00 | 24.00 |
| Dry-added ingredients | | | | | | |
| Sodium percarbonate having an AvOx of 14 wt % | 10.00 | 10.00 | 10.00 | | | 11.00 |
| Sodium carbonate | | | 2.50 | | | |
| Sodium sulphate | | | | 12.50 | 12.00 | |
| Acrylate/maleate copolymer | 1.50 | 1.50 | | 1.50 | 1.50 | |
| Enzymes | 0.50 | 0.50 | 0.50 | 0.50 | | 0.50 |
| Tetraacetylethylenediamine | 2.50 | 2.00 | 1.50 | | | 3.00 |
| Citric acid | 3.00 | 1.00 | 2.00 | 3.00 | 4.00 | 3.00 |
| Suds suppressor | 0.80 | 0.80 | 0.80 | 0.80 | 0.80 | 0.80 |
| Miscellaneous and water | to 100% | to 100% | to 100% | to 100% | to 100% | to 100% |

The invention claimed is:

1. A solid laundry detergent composition in particulate form comprising plurality of particulate components, the composition comprises:

(i) alkyl benzene sulphonate anionic detersive surfactant, part of which is in the form of a spray-dried particle and part of which is in the form of an agglomerate;

(ii) carboxylate polymer;

(iii) carbonate salt;

(iv) 0% zeolite builder;

(v) 0% phosphate builder; and (vi) 0% silicate salt;

wherein:

(a) any particulate component that comprises at least 5%, by weight of the particulate component, of alkyl benzene sulphonate anionic detersive surfactant also comprises carbonate salt, wherein the weight ratio of the carbonate salt to the alkyl benzene sulphonate anionic detersive surfactant present in the particulate component is greater than 1:1;

(b) any particulate component that comprises at least 5%, by weight of the particulate component, of alkyl benzene sulphonate anionic detersive surfactant also comprises carboxylate polymer, wherein the weight ratio of the alkyl benzene sulphonate anionic detersive surfactant to the carboxylate polymer present in the particulate component is in the range of from 0.2:1 to 5:1;

(c) the weight ratio of carbonate salt to carboxylate polymer present in the composition is in the range of from 4:1 to 30:1; and (d) 2% to 8%, by weight of the composition, of sodium bicarbonate; said composition exhibiting a turbidity in a wash liquid of less than 500 nephelometric units, measured at 9.2 grams of the composition in one liter of water at 20° C.

2. A composition according to claim 1, wherein any particulate component that comprises at least 5%, by weight of the particulate component, of alkyl benzene sulphonate anionic detersive surfactant also comprises carbonate salt, wherein the weight ratio of the carbonate salt to the alkyl benzene sulphonate anionic detersive surfactant present in the particulate component is greater than 1.5:1.

3. A composition according to claim 1, wherein any particulate component that comprises at least 5%, by weight of the particulate component, of alkyl benzene sulphonate anionic detersive surfactant also comprises carboxylate polymer, wherein the weight ratio of the alkyl benzene sulphonate anionic detersive surfactant to the carboxylate polymer present in the particulate component is in the range of 1:1 to 5:1.

4. A composition according to claim 1, wherein the weight ratio of carbonate salt to carboxylate polymer present in the composition is in the range of 5:1 to 20:1.

5. A composition according to claim 1, wherein the amount of caboxylate polymer in said any particulate component that comprises at least 5%, by weight of the particulate component, of alkyl benzene sulphonate anionic detersive surfactant also comprises up to 4.7%, by weight of the particulate component.

6. A composition according to claim 1, wherein the amount of caboxylate polymer in said any particulate component that comprises at least 5%, by weight of the particulate component, of alkyl benzene sulphonate anionic detersive surfactant also comprises up to 6.7%, by weight of the particulate component.

* * * * *